US005474344A

United States Patent [19]

Lee

[11] Patent Number: 5,474,344

[45] Date of Patent: Dec. 12, 1995

[54] MULTI-STAGE DOOR OPENING DEVICE

[75] Inventor: Sang-Il Lee, Seoul, Rep. of Korea

[73] Assignee: Bloxwich Korea Co., Ltd., Kyoungsangbuk-Do, Rep. of Korea

[21] Appl. No.: 219,825

[22] Filed: Mar. 30, 1994

[51] Int. Cl.[6] ..... E05C 17/04

[52] U.S. Cl. ..... 292/262; 292/265; 16/86 C

[58] Field of Search ..... 292/336.3, 338, 292/262, 278, 265, 266, 275, 277, DIG. 19, DIG. 15, 193; 16/86 A, 86 C, 86 B, 49, DIG. 17, 86 R

[56] References Cited

U.S. PATENT DOCUMENTS

| | | | |
|---|---|---|---|
| 2,032,600 | 3/1936 | Smith | 292/266 |
| 2,291,412 | 7/1942 | Schonitzer | 292/275 X |
| 3,000,659 | 9/1961 | Schlage et al. | 292/DIG. 53 X |
| 4,858,952 | 8/1989 | Sasaki et al. | 292/265 X |
| 5,152,030 | 10/1992 | Cogo | 16/86 C |
| 5,173,991 | 12/1992 | Carswell | 292/265 X |

FOREIGN PATENT DOCUMENTS

| | | | |
|---|---|---|---|
| 523402 | 1/1993 | European Pat. Off. | 292/278 |
| 4005285 | 8/1991 | Germany | 292/275 |
| 3-69781 | 3/1991 | Japan | 292/262 |
| 333068 | 8/1930 | United Kingdom | 16/86 C |
| 2266338 | 10/1993 | United Kingdom | 292/269 |
| 9317209 | 9/1993 | WIPO | 292/DIG. 15 |

*Primary Examiner*—Rodney M. Lindsey
*Attorney, Agent, or Firm*—Michael N. Meller

[57] ABSTRACT

A multi-stage door opening device. This device reliably retains the door as it was opened at a desired opening angle and generates no operational noise in opening and closing motions of the door and lengthens the using life. An arm is hinged to a car body and comprises a steel core totally coated with a high strength engineering plastic material. This arm is partially thinned in order to provide a plurality of locking portions. A hinge pin hole of the arm has a synthetic resin bushing placed beside the steel core. A stopper is engaged with a notched fixing portion of the arm for limiting a full door opening position. A locking unit is slidably penetrated by the arm and locked to one of the locking portions of the arm. A locking body of the locking unit receives a pair of roller units slidably contacting with the arm. Each roller unit comprises a roller carrier, a locking roller seated on the roller carrier and an elastic material placed on the back of the roller carrier for biasing the roller carrier and the roller toward the arm. The stopper comprises a shock absorber, having a plurality of shock absorbing projections, and a fixture having compression projections on its opposed sides.

3 Claims, 3 Drawing Sheets

Fig. 1
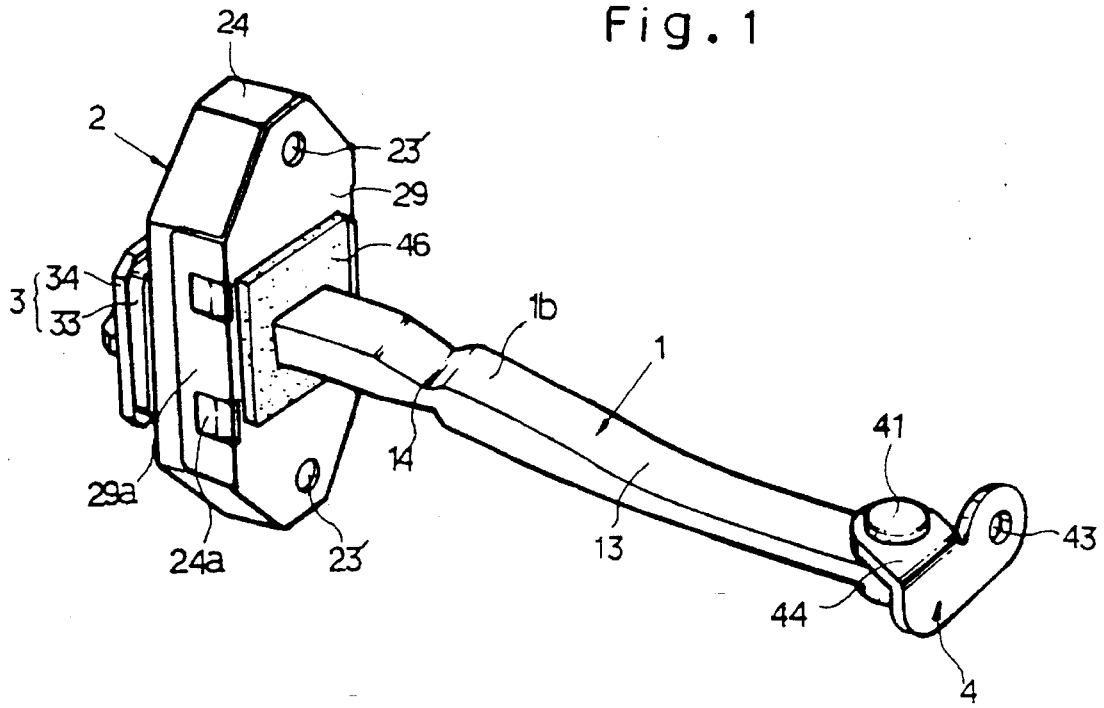
Fig. 2
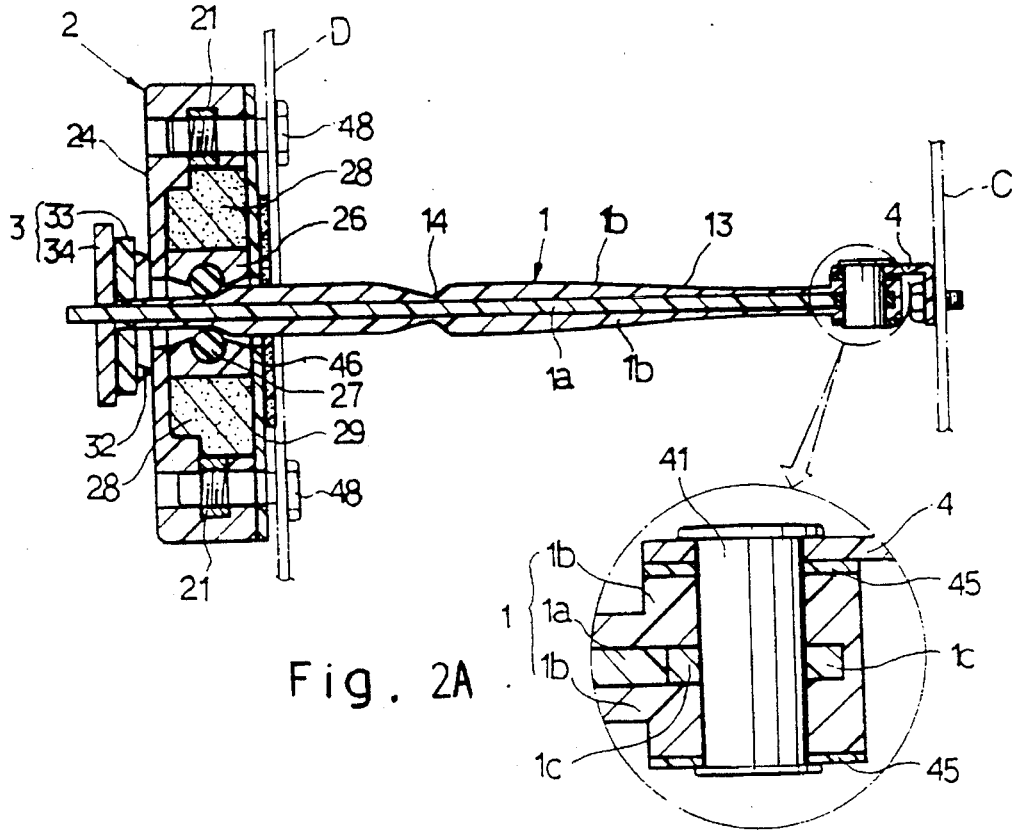
Fig. 2A (A)

(B)

MULTI-STAGE DOOR OPENING DEVICE

BACKGROUND OF THE INVENTION

1. Field of the Invention

The present invention relates in general to doors especially of a vehicle such as an automobile, a bus, a freight car and the like and, more particularly, to a device for opening and closing the door.

2. Description of the Prior Art

As well known to those skilled in the art, a conventional automobile door is hinged to a side frame of a car body and provided at its free edge with a locking device such as a retractable locking bolt. The conventional automobile door is thus turned about the hinged connections in order to be opened or closed. When the door is closed, the locking bolt of the door is engaged with a locking slot of the side frame of the car body and retains the closed state of the door. The conventional automobile door, while having no problem in its opening and closing motions, nevertheless has no means for retaining the door at a desired angular opening state. That is, the conventional automobile door can not be stably retained at an opened state since it has no means for retaining the door opening state. In this regard, when an opened state of the automobile door is continued for a time such as for loading or unloading goods on or from the automobile, the opened door may be unconsciously closed due to an outside force such as wind force or due to its own weight, the unconscious closing of the door due to the door weight being generated particularly when the automobile is stopped on a slope. Hence, the conventional automobile door causes a safety accident and a car body damage.

SUMMARY OF THE INVENTION

It is, therefore, an object of the present invention to provide a multi-stage door opening device in which the aforementioned problem can be overcome and which reliably retains the door as it was opened at a desired opening angle and generates no operational noise in opening and closing motions of the door and lengthens the using life of the door opening device.

In order to accomplish the above object, a multi-stage door opening device in accordance with an embodiment of the present invention comprises an arm having locking portions, the locking portions being formed by partially thinning the arm and elastically engaged with locking rollers, and a locking unit slidably inserted about and sliding along the arm and selectively elastically engaged with one of the locking portions of the arm.

The multi-stage door opening device according to the present invention is most preferably used for an automobile door. However, this door opening device may be used for other types of doors such as a furniture door.

The above door opening device reliably smoothly open the door in the multi-stage type without generation of operational noise. This opening device also improves its durability and has a light weight. Particularly since the door opening device is light in its weight, it saves the fuel when it is used in an automobile door.

BRIEF DESCRIPTION OF THE DRAWINGS

The above and other objects, features and other advantages of the present invention will be more clearly understood from the following detailed description taken in conjunction with the accompanying drawings, in which:

FIG. 1 is a perspective view of a multi-stage door opening device in accordance with an embodiment of the present invention;

FIGS. 2 and 2*a* are longitudinal sectional views of the door opening device of FIG. 1;

DESCRIPTION OF THE PREFERRED EMBODIMENTS

Figure 3:
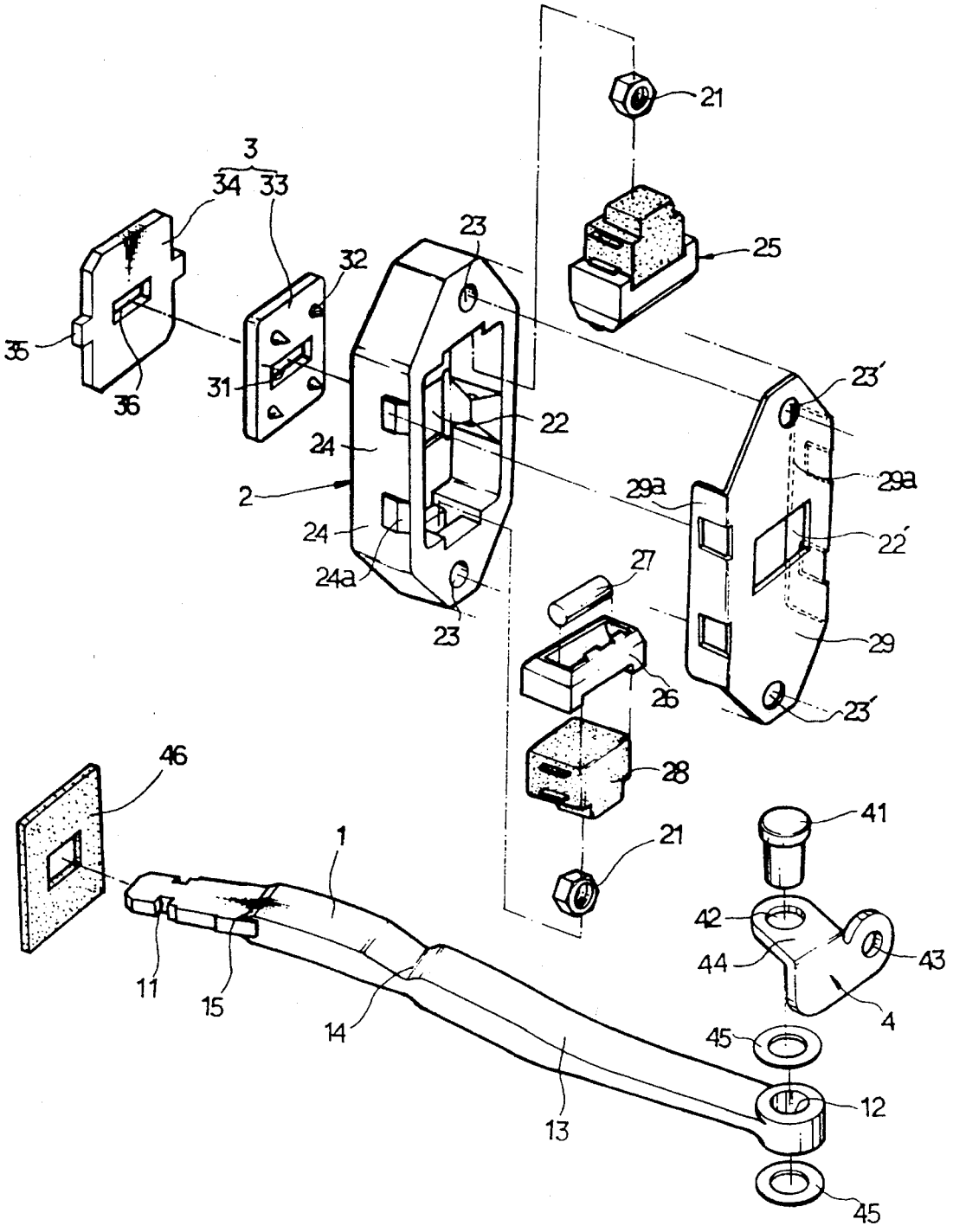
FIG. 3 is an exploded perspective view of the door opening device of FIG. 1.

With reference to FIGS. 1 to 3, there is shown a multi-stage door opening device in accordance with a preferred embodiment of the present invention. The door opening device includes a longitudinal arm 1 comprising a steel core 1*a* which is totally coated with an engineering plastic material 1*b*. The arm 1 is provided at an end thereof with a notched fixing portion 11 with which a stopper 3 is engaged in order to limit a movement of a locking unit 2 sliding along the arm 1. The other end of this arm 1 is provided with a pin hole 12 to which a bracket 4 is hinged. This bracket 4 is fixedly mounted on a car body C in order to hinge the arm 1 to the car body C (see FIGS. 4A and 4B). As best seen in FIG. 2, the pin hole 12 is provided with a synthetic resin bushing 1*c* which is placed beside an end of the steel core 1*a*. This bushing 1*c* is integrally formed with the plastic coating 1*b* of the arm 1 by an injection molding. Thanking for the bushing 1*c*, there is no steel part in the pin hole 12. The plastic coating 1*b* of the arm 1 is partially thinned at three portions, thus to be provided with first to third locking portions 13 to 15.

The door opening device also includes the locking unit 2 which receives the arm 1 and axially slides along the arm 1. This locking unit 2 comprises a locking body 24 having upper and lower engaging nuts 21, the nuts 21 being fixedly received in upper and lower fixing holes 23 of the body 24 respectively. This locking body 24 is also provided with a through hole 22 at its center and a plurality of snap protrusions 24*a* on its opposed side surfaces. A pair of opposed roller units 25 are received in upper and lower sections of a rectangular center recess of the locking body 24 such that their respective locking rollers 27 vertically face each other. Each of the roller units 25 comprises a roller carrier 26 for supporting the roller 27 in its roller seat. The roller carrier 26 is backed with an elastic material 28. The locking unit 2 further includes a cover 29 covering the center recess of the locking body 24 receiving the roller units 25. This cover 29 is provided with a center through hole 22' and upper and lower holes 23' corresponding to the center through hole 22 and the axial fixing holes 23 of the body 24 respectively. The cover 29 has an opposed side flanges 29*a* having snap holes snapping into their places about the snap protrusions 24*a* of the locking body 24. When the arm 1 is brought into slidable engagement with the locking unit 2, it is inserted into both the center through hole 22' of the cover 29 and the center through hole 22 of the locking body 24 and disposed between the locking rollers 27 of the roller units 25. Here, the locking body 24 as well as the cover 29 is made of a high strength engineering plastic material, thus to reliably retain and support both the engaging nuts 21 and the roller units 25 therein.

The above stopper 3 engaged with the notched fixing portion 11 of the arm 1 comprises a shock absorber 33 having a plurality of projections 32 on one surface thereof. This absorber 33 is also provided with a center through hole 31. The stopper 3 also includes a fixture 34 provided on its opposed sides with compression projections 35 for reliably fixing the shock absorber 33 to the fixing portion 11 of the arm 1. In the same manner as described for the shock absorber 33, the fixture 34 has a center through hole 36. The center through hole 36 of the fixture 34 is compressed in order to be reduced in its size when compressing the compression projections 35 toward the center through hole 36. The reduced through hole 36 is tightly engaged with the notched fixing portion 11 of the arm 1, thus to tightly engage the stopper 3 with the arm end having the fixing portion 11.

The bracket 4 hinges the arm 1 to the car body C and has a bent solid body. In order to hinge the arm 1 to the car body C, the bracket 4 is also hinged to the pin hole 12 of the arm 1 by a steel bracket pin 41 received in the pin hole 12. The bracket 4 receives the bracket pin 41 by a hole 42 formed on its horizontal section 44. This bracket 4 is fixedly mounted on the car body C through a fixing hole 43 formed on its vertical section.

Figure 4:
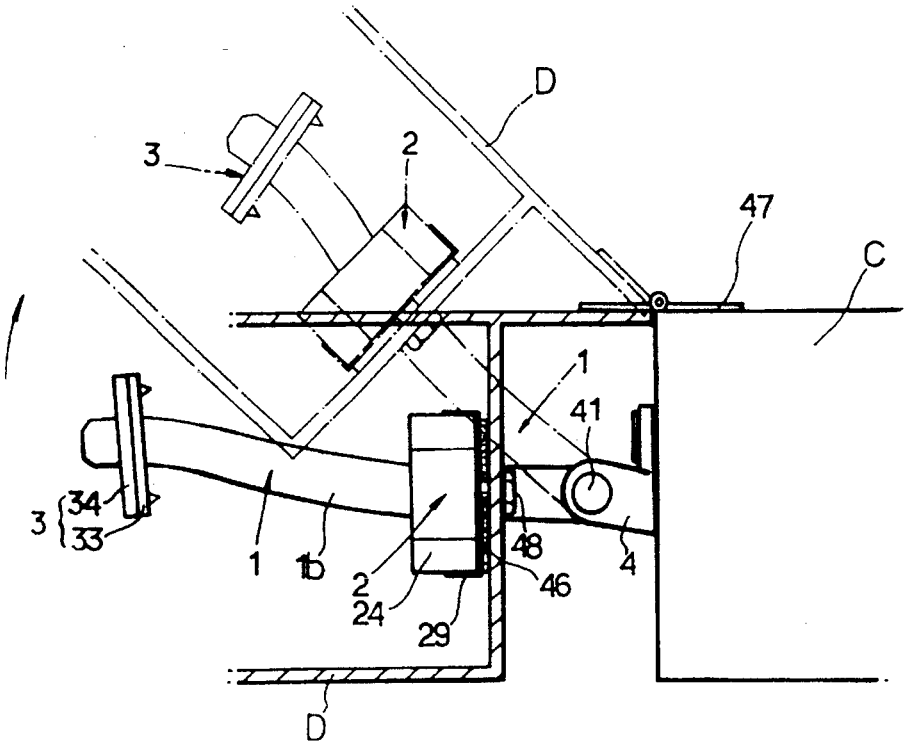
FIGS. 4A and 4B are schematic views showing a door closing operation and a door opening operation of the device of FIG. 1, respectively.
Figure 4:
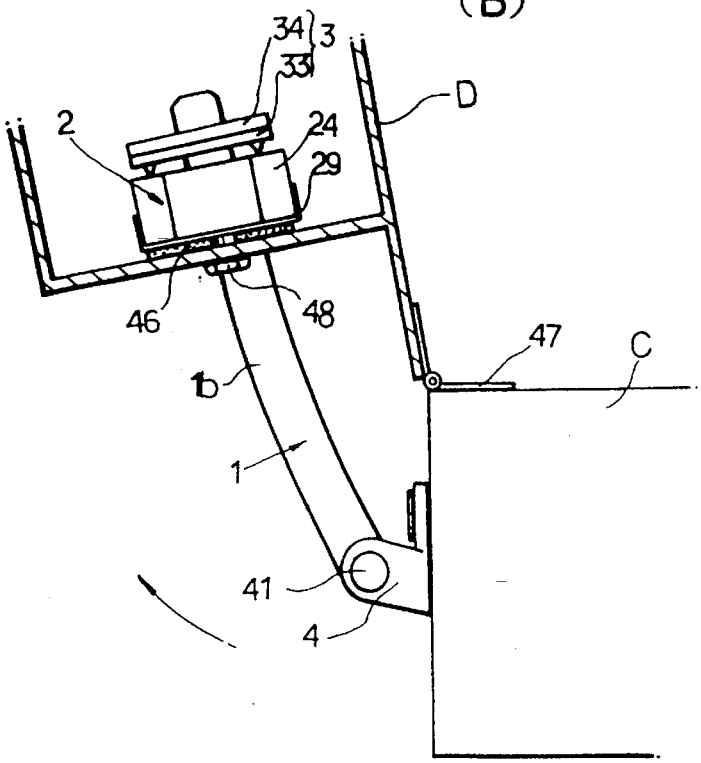

FIGS. 4A and 4B are schematic views showing a door closing operation and a door opening operation of the device of FIG. 1 respectively, when the device is used in an automobile door.

In the drawings, the alphabet D denotes the automobile door and the reference numeral 45 denotes washers, the numeral 46 denotes a pad for prevention of introduction of foreign substance into the locking unit 2, the numeral 47 denotes a hinge for hinging the door D to the car body C and the numeral 48 denotes a fixing bolt for fixing the locking unit 2 to the door D.

When mounting the door opening device of this invention on an automobile, the notched fixing portion 11 of the arm 1 is inserted into the locking unit 2 from the cover 29 having the pad 46. The locking unit 2 is, thereafter, mounted on the automobile door D. In order to mount the locking unit 2 on the automobile door D, the locking unit 2 is placed on a rear surface of the door D with interposition of the pad 46 and, thereafter, the bolts 48 are inserted into the upper and lower fixing holes 23 of the locking unit 2 and corresponding holes of the door D and threaded to the engaging nuts 21 tightly received in the upper and lower fixing holes 21 as shown in FIG. 2.

Thereafter, the stopper 3 limiting the fully opening state of the door D is brought into engagement with the notched fixing portion 11 of the arm 1. When engaging the stopper 3 with the notched fixing portion 11, the shock absorber 33 is inserted about the notched fixing portion 11 such that its projections 32 are directed to the locking member 2. The fixture 34 having the compression projections 35 is, thereafter, inserted about the notched fixing portion 11 of the arm 1. After inserting of the fixture 34, the compression projections 35 are compressed toward the center through hole 36 of the fixture 34, thus to reduce the size of the center through hole 36. Hence, the fixture 34 is tightly engaged with the notched fixing portion 11 of the arm 1 and to prevent separation of the locking unit 2 from the arm 1. Thereafter, the other end of the arm 1 is hinged to the car body C. In order to hinge the arm 1 to the car body C, the bracket 4 is fixedly mounted on the car body C and, thereafter, the steel bracket pin 41 is inserted into both the hole 42 of the bracket 4 and the pin hole 12 of the arm 1 with placing of the washers 45. The steel bracket pin 41 is, thereafter, subjected to a caulking. At this time, the pin hole 12 of the other end of the arm 1 has the synthetic resin bushing 1*c* which is integrally formed, by the injection molding, with the plastic coating 1*b* of the arm 1 at the place beside the end of the core 1*a* and corresponding to the pin hole 12. The bushing 1*c* has the same inner diameter as that of the pin hole 12. Thanking for the synthetic resin bushing 1*c*, the steel bracket pin 41 received in the pin hole 12 does not contact with the steel core 1*a* but contact with the synthetic resin bushing 1*c*, thus to generate no noise when turning the automobile door D. Since the bracket pin 41 does not contact with the hard core 1*a* but contact with the soft bushing 1*c*, its using life is lengthened.

The door opening and closing operations of the above device will be described hereinafter in conjunction with FIGS. 4A and 4B.

When the automobile door D is closed as shown at the solid line of FIG. 4A, the locking unit 2 mounted on the automobile door D is placed on the first locking portion 13 of the arm 1 while retaining its position near to the car body C. This first locking portion 13 of the arm 1 is thinner and prevents the door D from being unconsciously opened or playing even when the door D is applied with a light vibration or an outside shock.

At this time, the rollers 27 of the roller units 25 received in the locking unit 2 are strongly biased toward the upper and lower surfaces of the arm 1 respectively by the elastic forces of the elastic materials 28 provided on the backs of the roller carriers 26 of the roller units 25.

When the closed door D is pulled to be opened, the door D is turned about the hinge 47 as shown at the arrow of FIG. 4B. As a result of turning of the door D about the hinge 47, the locking unit 2 slides along the arm 1 to be away from the pin hole 12 as shown at the dash and dot line of FIG. 4A. While the locking unit 2 slides along the arm 1, the locking rollers 27 of the roller units 25 received in the locking unit 2 roll on the upwardly inclined surfaces of the arm 1 between the first locking portion 13 and the second locking portion 14. At this time, the roller units 25 smoothly retract in opposed directions while compressing the elastic materials 28, thus to cause their rollers 27 to reliably continue their tight contact with the upper and lower surfaces of the arm 1 regardless of curved shape of the arm 1. When the rollers 27 of the roller units 25 reach the thinner second locking portion 14, the rollers 27 as well as the roller carriers 16 advance in the opposed directions by the elastic force of the elastic materials 28, thus to be locked to the second locking portion 14.

The dash and dot line of FIG. 4A shows a first step door opening state wherein the roller units 25 of the locking unit 2 has been moved from the first locking portion 13 to the second locking portion 14. At this first step opening state, the door D retains its half opening state. When no outside force exceeding a predetermined level is applied to the door D in the above first step opening state, the door D is not unconsciously closed and not opened any more.

In order to fully open the door D, the door D is more forced in the direction shown at the arrow of FIG. 4B. When turning the door D as described above, the roller units 25 of the locking unit 2 engaged with the second locking portion 14 of the arm 1 are moved from the second locking portion 14 to the third locking portion 15. In this case, the rollers 27 of the roller units 25 roll on the upper and lower surfaces of the arm 1 in order to be moved from the second locking portion 14 to the third locking portion 15 while compressing the elastic materials 28. When the rollers 27 reach the thinner third locking portion 15 of the arm 1, the rollers 27 as well as the roller carriers 26 advance toward the arm 1 by the elastic force of the elastic materials 28, thus to be seated on and locked to the third locking portion 14 and to achieve the fully opening state of the door D.

When the automobile door D is fully opened as described above, the rear surface of the locking unit 2 comes into contact with the stopper 3 engaged with the notched fixing portion 11 of the arm 1, so that the locking unit 2 is not moved on the arm 1 any more. The mechanical shock generated when the locking unit 2 comes into contact with the stopper 3 is mostly absorbed by the projections 32 of the shock absorber 33, so that both the automobile door D and the locking unit 2 are scarcely applied with the mechanical shock and damaged.

When the automobile door D is fully opened, the roller units 25 of the locking unit 2 are locked to the third locking portion 15 of the arm 1. In this regard, when the fully opening state of the automobile door D should be continued for a time such as for loading or unloading goods, the opened door D is not unconsciously closed due to an outside force such as wind force or due to its own weight particularly when the automobile is stopped on a slope, thus to reliably prevent both a safety accident and a damage of the car body.

It should be understood that the arm 1 may have another locking portion in addition of the above three locking portions 13, 14 and 15 without affecting the functioning of this invention.

In order to close the opened door D, the door D in the state that the roller units 25 are locked to the third locking portion 15 of the arm 1 as shown in FIG. 4B is pushed in a direction opposed to the direction shown at the arrow of FIG. 4B. The rollers 27 of the roller units 25 thus roll on the arm surfaces while compressing the elastic materials 28, thus to be moved from the third locking portion 15 to the second locking portion 14 and provisionally locked to this second locking portion 14. When the pushing force applied to the door D is removed at this state, the door D will achieve the half opening state. When the door D in the half opening state is more pushed to be completely closed, the rollers 27 of the roller units 25 roll on the arm surfaces while compressing the elastic materials 28 and are moved from the second locking portion 14 to the first locking portion 13. Hence, the door D returns to its fully closed state as shown at the solid line of FIG. 4A.

As described above, in the multi-stage door opening device of the present invention, a locking unit sliding along an arm during a door opening motion is selectively locked to either a second locking portion or a third locking portion of the arm, so that the door reliably retains an opened state of a desired opening angle. In this regard, the door opening device of this invention prevents unconscious closing of the opened door due to an outside force of its own weight. The arm slidably engaged with the locking unit, comprises a steel core fully coated with a high strength engineering plastic material, thus to reduce the weight of the door opening device. Thanking for the plastic material fully coated on the steel core of the arm, a pair of steel rollers of the locking unit roll on the plastic material surface other than the steel core during door opening or door closing operation, thus to prevent generation of noise caused by a steel to steel frictional contact. Since the rollers of the locking unit roll on the plastic surfaces of the arm while coming into total contact with the plastic surfaces, the door opening and closing operations are smoothly carried out without malfunction.

The locking unit comprises a locking body and a cover which are made of a high strength engineering plastic material, so that it reduces its weight and causes both its bearing members and its fixing nuts to be stably retained in their places in it. In this regard, the door opening device prevents generation of operational noise and improves its durability. The arm is provided at an end thereof with a pin hole for receiving a steel bracket pin for hinging the door opening device to a car body. The pin hole has a synthetic resin bushing which is integrally simultaneously formed with the plastic material coating of the arm by an injection molding. Hence, the steel bracket pin comes into rotatable contact with the synthetic resin bushing and generates no noise during its rotation in the bushing. In addition, the synthetic resin bushing also prevents abrasion of the steel bracket pin, thus to increase the using life of the door opening device.

That is, all of the frictional contact parts of the door opening device of this invention such as the steel rollers, the arm and the steel bracket pin are constructed such that they come into movable contact with each other in the steel to plastic material contact type. Therefore, the relative movement of frictional contact parts is smoothly carried out without genera-Lion of frictional noise. The steel to plastic material contact of the frictional contact parts also remarkably reduces the weight of the door opening device and, as a result, saves the fuel of the automobile when the device is used in an automobile door.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A multi-stage door opening device comprising:

an arm hinged to a door support frame at one end thereof and including a metal core coated with an engineering plastic material over a major portion of its surface area, said arm having a notched fixing portion in said metal core at the other end thereof and partially thinned in order to provide a plurality of locking portions in said plastic material, the one end of said arm having a hinge pin hole provided with a synthetic resin bushing integrally formed with said engineering plastic material by an injection molding, said bushing being placed beside said metal core;

a stopper engaged with said notched fixing portion of the arm for limiting a full opening position of a door;

a bracket mounted on said door support frame and hinged to said pin hole of the arm, thus to hinge said arm to said door support frame; and a locking unit penetrated by said arm and locked to one of said locking portions of the arm, said locking unit being mounted on said door and comprising a locking body and a cover covering the locking body, both said locking body and said cover being made of an engineering plastic material, said locking body receiving at least one fixing nut and at least one roller unit having a locking roller slidably contacting said arm for moving said locking unit into different locking portions along said arm with said roller unit having elastic means for urging the roller unit against the arm such that the locking roller maintains tight contact with the arm independent of arm thickness.

2. The multi-stage door opening device according to claim 1, wherein said roller unit comprises:

a roller carrier having a roller seat and a lower groove;

with said locking roller seated on said roller seat and rolling on said arm; and with said elastic means comprising an elastic material mounted upon the lower groove of said roller carrier for biasing said roller carrier as well as said locking roller toward said arm.

3. The multi-stage door opening device according to claim 1, wherein said stopper comprises:

a shock absorber having a plurality of shock absorbing projections on its surface; and a fixture having compression projections on its opposed sides for reliably engaging said stopper with said notched fixing portion of the arm.

* * * * *